US005472930A

United States Patent [19]

Podszun et al.

[11] Patent Number: 5,472,930

[45] Date of Patent: Dec. 5, 1995

[54] THERMOSENSITIVE RECORDING MATERIAL

[75] Inventors: Wolfgang Podszun, Köln, Germany; Herman Uytterhoeven, Bonheiden, Belgium

[73] Assignee: Agfa-Gevaert AG, Leverkusen, Germany

[21] Appl. No.: 194,608

[22] Filed: Feb. 10, 1994

[30] Foreign Application Priority Data

Feb. 19, 1993 [DE] Germany ..... 43 05 165.0

[51] Int. Cl.[6] ..... B41M 5/30

[52] U.S. Cl. ..... 503/214; 428/198; 428/212; 428/532; 428/535; 428/913; 503/200; 503/202; 503/209; 503/226

[58] Field of Search ..... 428/195, 211, 428/535, 537.5, 913, 914, 212, 532; 503/200, 216, 217, 201, 202, 226, 209, 214

[56] References Cited

U.S. PATENT DOCUMENTS 3,161,770 12/1964 Huett et al. ..... 250/65

FOREIGN PATENT DOCUMENTS 0518470 12/1992 European Pat. Off. ..... 503/218
2110399 6/1983 United Kingdom ..... 503/226

*Primary Examiner*—B. Hamilton Hess
*Attorney, Agent, or Firm*—Connolly & Hutz

[57] ABSTRACT

A thermosensitive recording material contains a mono-, oligo- or polysaccharide and a catalyst in one or more binder layers arranged on a transparent support. A black-and-white image with high optical density, good grey step reproduction, great sharpness and good stability is formed when the material is heated imagewise, e.g. by means of a thermohead.

19 Claims, No Drawings

THERMOSENSITIVE RECORDING MATERIAL

This invention relates to a transparent thermosensitive recording material based on mono-, oligo- or polysaccharides.

Direct thermal recording processes are particularly user friendly compared with other recording processes and have decided ecological advantages since no expendable materials are required apart from the recording material and no waste is produced. These recording materials may be inscribed, for example, with a thermohead or a laser beam.

Known direct thermal recording materials are based e.g. on the reaction of a leuco dye with a dye developer, this reaction being released by the action of heat. The materials required are simple in construction and easy to handle and are used, for example, in telecopiers, cash registers or measuring instruments. They are not suitable, however, for more high quality applications because their image stability, in particular the stability to light, and the maximum density obtainable are insufficient. Moreover, it is difficult to produce transparent thermosensitive recording materials based on leuco dyes.

In U.S. Pat No. 3,161,770 there is described a thermographic reproduction paper and method of using. A thermographic recording material is used which has been obtained by treating a carrier material with a mixture of a reducing carbohydrate and an organic acid. As carrier material mainly paper is used; the treatment solution is soaked into the paper. Transparent recording materials cannot be obtained in this way. But also when a transparent layer support is used instead of an opaque paper layer support (the US patent mentions clear plastic materials, such as "Mylar"), only images with insufficient density and stability can be obtained. The transparent layer support materials do not absorb the treatment solutions and a tacky layer is formed on the surface of the transparent support. Because of the high tackiness the use with thermoprinters is not possible.

It is an object of the present invention to provide a transparent thermosensitive recording material which enables a high optical density together with a high transparency to be obtained and gives rise to very stable images, when used with thermoprinters.

The present invention relates to a thermosensitive recording material consisting of a transparent support material and one or more binder layers arranged thereon, of which at least a first binder layer contains a mono-, oligo- or polysaccharide and wherein at least one binder layer which may be or may not be identical with said first binder layer contains a catalyst.

Suitable transparent support materials include plastic films, e.g. of polyethylene terephthalate, cellulose esters such as cellulose acetate, cellulose propionate and cellulose butyrates as well as polycarbonates or polyimides.

The transparent recording material according to the invention contains mono-, oligo- or polysaccharides which commonly are referred to herein as saccharide. Examples include the monosaccharides galactose, glucose, idose, mannose, fructose, sorbose, ribose and xylose. Not only monosaccharides of the formula $C_n(H_2O)_n$ may be used but also desoxymonosaccharides. Examples of suitable oligosaccharides include sucrose, maltose, trehalose, lactose and tri- and tetrasaccharides derived from sucrose, such as raffinose and stachyose. Among the polysaccharides, starch is particularly suitable. Particularly suitable are (poly)saccharides which contain a keto group or a ketal group.

The quantity of saccharide is important in determining the optical density obtainable and is generally from 0.5 to 30 $g/m^2$, preferably from 1 to 20 $g/m^2$, most preferably from 2 to 15 $g/m^2$.

Suitable binders for the saccharide are binders which are water-soluble and can be applied from aqueous dispersions, for example: Polyvinyl alcohol, partially saponified polyvinyl acetates, polyvinyl pyrrolidone, high molecular weight polyethylene oxide, copolymers of polyvinyl pyrrolidone and vinyl acetate, and latices of acrylate copolymers, polyvinyl chloride and vinyl chloride copolymers. The proportion of binder in a layer containing the saccharide is from 5 to 90% by weight, preferably from 5 to 70% by weight, most preferably 8 to 50% by weight.

Suitable catalysts include metal compounds, in particular salts of transition metals, and acids (protonic acids and Lewis acids). Inorganic and organic protonic acids are particularly effective. Sulfonic acids and phosphonic acids are preferred, for example, benzene sulfonic acid, p-toluene sulfonic acid and o-toluene sulfonic acid.

The quantity of catalyst used is generally from 0.1 to 20 $g/m^2$, preferably from 0.5 to 10 $g/m^2$.

The saccharide and the catalyst may be situated in the same layer but are preferably in separate layers. A two-layered arrangement comprising a saccharide layer and a catalyst layer are very suitable. Higher optical densities can be obtained with a multilayered arrangement in which several catalyst layers alternate with saccharide layers.

A polymeric binder having a specified glass transition temperature (Tg) is preferably used in the catalyst layer. The Tg should be from 40° to 150° C., preferably from 60° to 120° C. Binders from various classes of polymers may be used, e.g. polyamides, polyesters, polycarbonates, vinyl polymers and cellulose derivatives. The following are examples: Polyvinyl chloride, poly(vinyl chloride-co-vinyl acetate), poly(vinylidene chloride-co-vinyl acetate), styrene/-acrylonitrile copolymers, styrene/acrylonitrile/acrylate terpolymers, polyvinyl butyral and cellulose aceto-butyrate. The binder content in the catalyst layer is generally from 40 to 80% by weight.

It is particularly advantageous using in the the catalyst layer or an adjacent layer a binder which is decomposed exothermically when heated in the presence of the catalyst. Cellulose nitrate and nitrated starch are examples of such binders. Recording materials with exceptionally high thermal sensitivity are then obtained.

In one particular embodiment of the present invention, a polymeric barrier layer is placed between the saccharide layer and the catalyst layer. This barrier layer increases the stability of the recording material by separating saccharide from catalyst. The polymer of the barrier layer should have a melting and/or softening temperature above 40° C., preferably above 50° C. Suitable polymers for this barrier layer are inter alia the substances mentioned above as binders for the catalyst layer. Polyureas obtained by the reaction of di- or triisocyanates with aliphatic diamines are also very suitable. The layer thickness of the barrier layer is from 0.05 to 5 μm, preferably from 0.3 to 3 μm.

The recording material according to the invention may, of course, also contain other layers known for such applications. Thus it may be advantageous to apply a top coat as the uppermost layer. This top coat usually has a thickness of from 0.05 to 2.5 μm.

The top coat may have anti-adhesive properties which can be obtained e.g. by using polysiloxanes, polysiloxane/polyether block copolymers or fluorine polymers.

If the image material is to be inscribed with a thermo head, it has been found suitable to apply a thermostable top coat. Polymers suitable for this purpose have a softening point above 100° C., preferably above 130° C. Polycarbonates are very suitable, in particular homo- and copolymers of trimethyl cyclohexyl bisphenol polycarbonate. The last-mentioned polymers result in image materials with exceptionally high gloss and good image sharpness. Soiling of the thermohead by the image material due to sticking or abrasion does not occur.

An additional advantage of these polymers is that they are simple to apply, e.g. by casting from organic solution.

Known techniques may be employed for producing the recording materials according to the invention. These materials are advantageously produced by casting or knife coating. Particularly good results are obtained if the saccharide layer is cast from water and the catalyst layer from a non-aqueous solvent. Suitable solvents for the preparation of the catalyst layer are, for example, acetone, methyl ethyl ketone, tetrahydrofuran, dioxane, dichloromethane, tetrachloromethane and ethyl acetate. The barrier layer may be produced either from organic solution or from an aqueous dispersion, depending on the nature of the polymer selected for this layer. For producing barrier layers from polyureas, the di- or triisocyanate and diamine used as starting components are cast separately. The reaction to form the urea then takes place in the barrier layer itself.

The thermosensitive recording materials according to the invention may be inscribed, for example, with a thermohead and give rise to black-and-white images with high optical density, good reproduction of grey steps, great sharpness and good stability. The materials may also be inscribed with an infrared laser, in which case an infra-red absorbent is added to the recording material, preferably to the catalyst layer and/or the saccharide layer.

The recording material according to the invention and the recording process are also particularly advantageous from an ecological point of view.

The chemical reactions leading to the formation of the optical density are not understood in detail.

EXAMPLES

Example 1

Thermosensitive Recording Material

A first layer of sucrose (4.5 g/m$^2$) and polyvinyl alcohol (Moviol® 40-88) (0.5 g/m$^2$) is applied from water to a polyethylene terephthalate support having a thickness of 63 μm. The layer is dried at 80° C. for 5 minutes. This layer is covered by a second layer of a mixture of benzene sulfonic acid (3.6 g/m$^2$) and polyvinyl butyral (Butvar® B-79) (0.4 g/m$^2$) cast from methyl ethyl ketone and this second layer is dried under vacuum at 35° C. This in turn is covered by a solution of trimethyl cyclohexyl bisphenol polycarbonate (1.5 g/m$^2$) and polysiloxane-polyether-block copolymer (Tegoglide®) (0.1 g/m$^2$) in methyl ethyl ketone to produce a top coat which is then dried under vacuum at 35° C. for 10 minutes.

Example 2

Thermosensitive Recording Materials

Recording materials having the composition described in the following Table were produced as described in Example 1 except that p-toluene sulfonic acid was used instead of benzene sulfonic acid.

| No. | 1st Layer | 2nd Layer | 3rd Layer | Topcoat |
|---|---|---|---|---|
| 2A | 4.5 g/m$^2$ glucose | 4.0 g/m$^2$ p-TSS | — | 0.15 g/m$^2$ |
| | 0.5 g/m$^2$ PVA | 6.0 g/m$^2$ SAN-Acr. | | Tegoglide |
| 2B | 3.6 g/m$^2$ glucose | 3.2 g/m$^2$ p-TSS | — | 0.15 g/m$^2$ |
| | 0.4 g/m$^2$ PVS | 2.8 g/m$^2$ SAN-Acr. | | Tegoglide |
| 2C | 9.0 g/m$^2$ glucose | 1.6 g/m$^2$ p-TSS | 1.5 g/m$^2$ nitro-cellulose | 0.15 g/m$^2$ |
| | 1.0 g/m$^2$ PVA | 2.4 g/m$^2$ SAN-Acr. | | Tegoglide |
| 2D | 9.0 g/m$^2$ glucose | 1.6 g/m$^2$ p-TSS | 3.5 g/m$^2$ nitro-cellulose | 0.15 g/m$^2$ |
| | 1.0 g/m$^2$ PVA | 2.4 g/m$^2$ SAN-Acr. | | Tegoglide |
| 2E | 9.0 g/m$^2$ glucose | 1.6 g/m$^2$ p-TSS | — | 1.0 g/m$^2$ TMC-PC |
| | 1.0 g/m$^2$ PVA | 2.4 g/m$^2$ Butvar | | |
| 2F | 1.6 g/m$^2$ p-TSS | 9.0 g/m$^2$ glucose | — | 1.0 g/m$^2$ TMC-PC |
| | 2.4 g/m$^2$ Butvar | 1.0 g/m$^2$ PVA | | |
| 2G | 1.6 g/m$^2$ p-TSS | 9.0 g/m$^2$ glucose | 1.6 g/m$^2$ p-TSS | 1.0 g/m$^2$ TMC-PC |
| | 2.4 g/m$^2$ Butvar | 1.0 g/m$^2$ PVA | 2.4 g/m$^2$ Butvar | |

Explanation of Starting Materials

| | |
|---|---|
| p-TSS | p-Toluene sulfonic acid |
| SAN-Acr. | Terpolymer of 56.5% by wt. styrene, 22.5% by weight ethyl-hexylacrylate and 18% by weight acrylonitrile |
| Butvar ® | Polyvinyl butyral |
| PVA | Polyvinyl alcohol, Moviol ® 40-88 |
| Tegoglide ® | Polysiloxane/polyethylene oxide block copolymer |
| TMC PC | Trimethylol cyclohexyl bisphenol polycarbonate |

Example 3

Tests for Technical Application

The optical density of the recording materials from Examples 1 and 2 was measured in transmission. Sample prints were produced by means of a thermostatically controllable stamp as test instrument. The stamp produced an image pattern having light and dark areas. The optical density in the dark areas is defined as D-max and that in the light areas as D-min Definition of the Measured Variables

| | |
|---|---|
| D-O | Density after production |
| D-45-14d | Density after 14 days' storage at 45° C. |
| D-max-130 | Density in the dark areas of a test image printed at 130° C. |
| D-min-130 | Density in the light areas of a test |
| D-max-150 | Density in the dark areas of a test image printed at 150° C. |
| D-min-150 | Density in the light areas of a test image printed at 150° C. |
| D-max-180 | Density in the dark areas of a test image printed at 180° C. |
| D-min-180 | Density in the light areas of a test image printed at 180° C. |

Results of Measurements

| Ex. No. | D-O | D-45-14d | D-max-130 | D-min-130 | D-max-150 | D-min-150 | D-max-180 | D-min-180 |
|---|---|---|---|---|---|---|---|---|
| 1 | 0.03 | 0.03 | 0.46 | 0.04 | 0.66 | 0.05 | 0.98 | 0.06 |
| 2A | 0.03 | 0.03 | 0.38 | 0.05 | 0.67 | 0.05 | 0.06 | 0.05 |
| 2B | 0.03 | 0.04 | 0.45 | 0.05 | 0.73 | 0.05 | 0.78 | 0.06 |
| 2C | 0.03 | 0.07 | 1.05 | 0.09 | 1.53 | 0.14 | 1.98 | 0.42 |
| 2D | 0.03 | 0.11 | 1.35 | 0.16 | 1.74 | 0.29 | 2.45 | 0.46 |
| 2E | 0.03 | 0.03 | 0.92 | 1.07 | 1.45 | 0.16 | 1.85 | 0.16 |
| 2F | 0.03 | 0.03 | 0.83 | 0.06 | 1.28 | 0.12 | 1.48 | 0.15 |
| 2G | 0.03 | 0.06 | 1.08 | 0.08 | 1.67 | 0.23 | 3.24 | 0.26 |

The D-O-values show that the materials according to the invention are highly transparent. The values after 14 days' storage at 45° C. confirm the good stability. The density values distinctly increase with increasing temperature, whereby establishment of grey steps is possible. The maximum densities obtainable lie in a technically interesting range.

Example 4

(For Comparison and Corresponding to Example II of U.S. Pat. No. 3,161,770)

Thermographic recording materials were prepared following the description of Example II of U.S. Pat. No. 3,161,770 but with the following modifications:

Instead of "cellulosic reproduction paper" a hydrophilized polyethylene terephthalate having a thickness of 100 μm was used (as transparent layer support).

Instead of using a solution-wet roller the solutions were coated by knife coating.

The following solutions were used:

| | Water | m-benzene disulfonic acid | urea | sucrose |
|---|---|---|---|---|
| 4A | 100 g | 28.5 g | 14.4 g | 0 g |
| 4B | 100 g | 28.5 g | 14.4 g | 2 g |
| 4C | 100 g | 28.5 g | 14.4 g | 5 g |
| 4D | 100 g | 28.5 g | 14.4 g | 10 g |

The solutions were coated to a wet layer thickness of 15 μm and the layers were subsequently dried thoroughly at 70° C. The recording materials obtained were so tacky that they could not be printed using a thermoprinter or a thermostamp. Thus the materials were unsuitable for technical use.

In order to evaluate the thermosensitivity the materials were exposed a short time (15 seconds) in an oven to a temperature of 181° C. (360° F.). Subsequently the optical densities (D-max) were determined in transmission.

| | D-min | D-max |
|---|---|---|
| 4A | 0.06 | 0.12 |
| 4B | 0.07 | 0.15 |
| 4C | 0.06 | 0.20 |
| 4D | 0.08 | 0.22 |

The optical densities are too low.

We claim:

1. Thermosensitive recording material consisting of a transparent support material and arranged thereon, at least a first binder layer containing a mono-, oligo- or polysaccharide and at least a second binder layer which is not identical with said first binder layer and wherein said second binder layer contains a catalyst.

2. A recording material as claimed in claim 1, wherein the second binder layer which contains a binder having a glass transition temperature of from 40° to 150° C.

3. The recording material as claimed in claim 2, wherein the second binder has a glass temperature of from 60° to 120° C.

4. A recording material as claimed in claim 1, wherein a barrier layer is arranged between the saccharide layer and the catalyst layer.

5. A recording material as claimed in claim 1, wherein the catalyst is a sulfonic acid.

6. A recording material as claimed in claim 1, wherein the second binder layer or an adjacent layer to said binder layer contains a binder which is decomposed exothermically when heated in the presence of the catalyst.

7. A recording material as claimed in claim 1, which contains a top coat of a polymer having a softening temperature above 100° C.

8. The recording material as claimed in claim 1, wherein the transparent support material is selected from the group consisting of polyethylene terephthalate, cellulose esters, polycarbonates and polyimides.

9. The recording material as claimed in claim 8, wherein the cellulose ester is selected from the group consisting of cellulose acetate, cellulose propionate and cellulose butyrate.

10. The recording material as claimed in claim 1, wherein said first binder saccharide layer contains mono-, oligo- or poly-saccharide selected from the group consisting of galactose, glucose, idose, mannose, fructose, sorbose, ribose, xylose, desoxymonosaccharides, sucrose, maltose, trehalose, lactose, raffinose, stachyose and starch.

11. The recording material as claimed in claim 10, wherein the saccharide is present from 0.5 to 30 g/m$^2$.

12. The recording material as claimed in claim 10, wherein the saccharide is present from 1 to 20 g/m$^2$.

13. The recording material as claimed in claim 10, wherein the saccharide is present from 2 to 15 g/m$^2$.

14. The recording material as claimed in claim 1, wherein the binder for the saccharide layer is selected from the group consisting of polyvinyl alcohol, partially saponified polyvinyl acetates, polyvinyl pyrrolidone, high molecular weight polyethylene oxide, copolymers of polyvinyl pyrrolidone and vinyl acetate, and latices of acrylate copolymers, polyvinyl chloride and vinyl chloride copolymers.

15. The recording material as claimed in claim 14, wherein the binder is present in the layer containing the saccharide in an amount from 5 to 90% by weight.

16. The recording material as claimed in claim 14, wherein the binder is present in the layer containing the saccharide in an amount from 5 to 70% by weight.

17. The recording material as claimed in claim 14, wherein the binder is present in the layer containing the saccharide in an amount from 8 to 50% by weight.

18. The recording material as claimed in claim 1, wherein the catalyst is selected from the group consisting of salts of transitional metals, inorganic and organic protonic acids and Lewis acids and wherein the catalyst is used is from 0.1 to 20 $g/m^2$.

19. The recording material as claimed in claim 18, wherein the catalyst is selected from the group consisting of benzoic sulfonic acid, p-toluene sulfonic acid and o-toluene sulfonic acid and is present in a quantity from 0.5 to 10 $g/m^2$.

* * * * *